US009345281B1

(12) United States Patent
Schiebl

(10) Patent No.: US 9,345,281 B1
(45) Date of Patent: May 24, 2016

(54) CHIN GUARD WITH FIXED STRAPS

(71) Applicant: Paul Schiebl, Houston, TX (US)

(72) Inventor: Paul Schiebl, Houston, TX (US)

( * ) Notice: Subject to any disclaimer, the term of this patent is extended or adjusted under 35 U.S.C. 154(b) by 303 days.

(21) Appl. No.: 13/849,413

(22) Filed: Mar. 22, 2013

Related U.S. Application Data

(60) Provisional application No. 61/614,198, filed on Mar. 22, 2012.

(51) Int. Cl.
*A42B 3/08* (2006.01)

(52) U.S. Cl.
CPC ..... *A42B 3/08* (2013.01)

(58) Field of Classification Search
CPC ..... A42B 3/08; A42B 3/105; A42B 3/205; A42B 3/326
USPC ..... 2/425, 421
See application file for complete search history.

(56) References Cited

U.S. PATENT DOCUMENTS 3,619,813 A * 11/1971 Marchello ..... 2/421
3,916,446 A * 11/1975 Gooding ..... A42B 3/08 2/421
4,741,054 A * 5/1988 Mattes ..... 2/421
5,685,020 A * 11/1997 Powell et al. ..... 2/421
5,794,274 A * 8/1998 Kraemer ..... 2/421
6,081,932 A * 7/2000 Kraemer ..... 2/421
6,298,483 B1 10/2001 Schiebl et al.
6,324,701 B1 * 12/2001 Alexander ..... 2/421
6,481,024 B1 * 11/2002 Grant ..... 2/421
6,499,147 B2 12/2002 Schiebl et al.
D606,707 S 12/2009 Schiebl
7,735,160 B1 6/2010 Schiebl
D620,205 S 7/2010 Schiebl
D620,837 S 8/2010 Schiebl
D623,088 S 9/2010 Schiebl
D628,515 S 12/2010 Schiebl
7,895,677 B1 3/2011 Schiebl
8,006,322 B1 8/2011 Schiebl
D657,497 S 4/2012 Schiebl
8,621,671 B1 * 1/2014 Schiebl ..... 2/421
2004/0003452 A1 1/2004 Schiebl
2007/0124842 A1 * 6/2007 Nascimento et al. ..... 2/9
2009/0107514 A1 * 4/2009 Winningham ..... 128/857
2014/0068844 A1 * 3/2014 Infusino et al. ..... 2/421

* cited by examiner

*Primary Examiner* — Alissa L Hoey
(74) *Attorney, Agent, or Firm* — Egbert Law Offices, PLLC

(57) ABSTRACT

A chin guard assembly that includes a shell having an outer and inner surface, an outer peripheral edge extending around the shell, and a first and second end. The first and second ends each having at least one slot configured to receive a strap with each strap extending through the at least one slot and outwardly from each end, wherein one strap is fixed to the shell at the first end and one strap is fixed to the shell at the second end.

9 Claims, 5 Drawing Sheets

CHIN GUARD WITH FIXED STRAPS

CROSS-REFERENCE TO RELATED APPLICATIONS

This application claims priority from U.S. Provisional Application No. 61/614,198 filed Mar. 22, 2012.

TECHNICAL FIELD

The present invention relates to chin guards for use with helmets, and more particularly with chin guards having straps that are fixed relative to the chin guard.

BACKGROUND OF THE INVENTION

Protective helmets to minimize head injuries have been known and used for many years in which the addition of a face mask attached to the helmet provides protection to the face of the wearer. Football helmets are usually equipped over the exposed face area with a vinyl coated wire or other metal structure, or an injection molded plastic face mask. Protective helmets usually include a chin guard assembly to retain the helmet on the head of the wearer. Chin guards are frequently constructed using a molded plastic cup made of compression or injection-molded plastic material and preferably, a pad is bonded or otherwise attached to the plastic cup. Non-padded chin guard assemblies do not offer any impact protection to the chin area and only serve to secure the helmet to the player's head. Most molded plastic chin cups currently in use are molded in a manner which allows the formed cup to flex upon impact. An improved construction of a chin cup is one in which a rigid material is used that does not flex on impact to an undesirable degree, thus distributing the impact force over a larger area of the chin.

One of the problems with existing chin guard assemblies is the relationship between the strap and the chin guard. Certain chin guards have adjustable straps in which the position of the strap relative to the chin guard can be directly adjusted at the chin guard. However, during the strong impacts of football play, the chin guard can slip and move relative to the strap. As a result, the chin guard assembly will be in an undesirable and unsafe location. As such, a need exists to provide a chin guard assembly in which the strap is positioned in a fixed relationship relative to chin guard.

It is an object of the present invention to provide a chin guard assembly in which the straps are fixedly connected thereto and are non-adjustable with respect to the chin guard. It is another object of the present invention to provide a chin guard assembly in which the outer surface of the straps are flush with the outer surface of the shell of the chin guard. It is still another object of the present invention to provide a chin guard assembly which avoids dislocations of the chin guard during use.

These and other objects and advantages of the present invention will become apparent from a reading of the attached specification and appended claims and appended claims.

BRIEF SUMMARY OF THE INVENTION

The present invention is directed to a chin guard assembly comprising: a shell having an outer and inner surface, an outer peripheral edge extending around the shell, and a first and second end; the first and second ends each having at least one slot configured to receive a strap; each strap extends through the at least one slot and outwardly from each end; wherein one strap is fixed to the shell at the first end and one strap is fixed to the shell at the second end. The at least one slot further includes a first and second slot.

The shell includes a center portion between the first and second ends in which the first and second ends are of a thicker dimension than the center portion. The first slot of each end extends in a generally transverse relationship to the second slot of each end in which each slot opens into an indented area on the outer surface of the shell, wherein the indented area is configured to receive the strap.

The inner surface of the shell further comprises a first channel extending from the first slot of each end to the outer peripheral edge of the shell and a second channel extending from the second slot of each end to the outer peripheral edge of the shell, the first and second channels being configured to receive the strap.

The indented areas on the outer surface of the shell and the first and second channels on the inner surface of the shell allow the straps to lay flush with the outer and inner surface of the shell.

A first hole is formed through the shell in the area of the first channel and a second hole is formed through the shell in the area of the second channel, the first and second holes being configured to receive a fastener. The first and second holes include a countersunk portion on the outer surface of the shell.

The at least one portion of each strap is fixed to each end of the shell by a fastener inserted in either the first or second hole formed though the shell. At least two portions of each strap are fixed to each end of the shell by a fastener inserted in both the first and second holes formed though the shell.

The fasteners are selected from the group consisting of rivets, spot welding, pins, pins formed as part of the shell, and adhesives.

The chin guard assembly further comprises a resilient layer having an inner and outer surface, a periphery and first and second ends, wherein the inner surface and periphery are textured.

The first and second ends of the outer surface of the resilient layer further comprise a first indented area and a second indented area corresponding to a first channel and a second channel formed on the inner surface of the shell. The first and second indented areas are configured to serve as guides for the straps and allow for the straps to be flush with the periphery of the resilient layer when it is positioned within the shell.

The chin guard assembly comprises: a shell and a resilient layer; the shell having an outer and inner surface, an outer peripheral edge extending around the shell, and a first and second end; the first and second ends of the shell each having a least one slot configured to receive a strap wherein each strap extends through the at least one slot and outwardly from each end in which one strap is fixed to the shell at the first end and one strap is fixed to the shell at the second end. The inner surface of the shell has a first channel extending from the first slot of each end to the outer peripheral edge of the shell and a second channel extending from the second slot of each end to the outer peripheral edge of the shell, the first and second channels being configured to receive the strap. The resilient layer has an inner and outer surface, a periphery and first and second ends, wherein the inner surface and periphery are textured. The first and second ends of the outer surface of the resilient layer has a first indented area and a second indented area corresponding to a first channel and a second channel formed on the inner surface of the shell wherein the first and second indented areas are configured to serve as guides for the straps and allow for the straps to be flush with the periphery of the resilient layer when it is positioned within the shell. The at least one slot further includes a first and second slot.

The resilient layer for a chin guard assembly comprising: a resilient layer having an inner and outer surface, a periphery and first and second ends, wherein the inner surface and periphery are textured; wherein the first and second ends of the outer surface of the resilient layer further comprise a first indented area and a second indented area configured to serve as guides for straps attached to the chin guard assembly which allow for the straps to be flush with the periphery of the resilient layer when it is positioned within the chin guard assembly.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
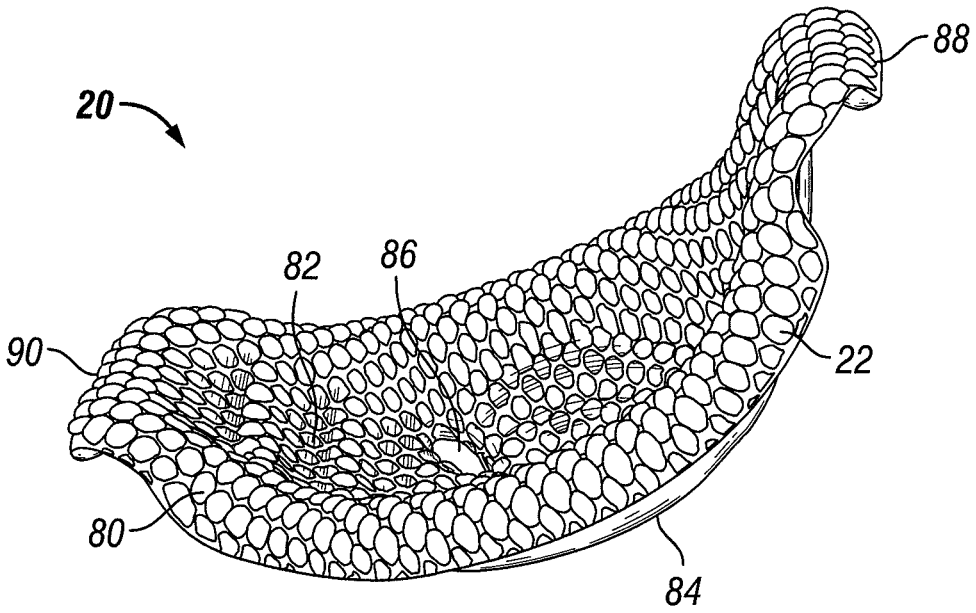
FIG. 1 is a perspective view of the inner surface of a resilient layer of the subject invention.
Figure 2:
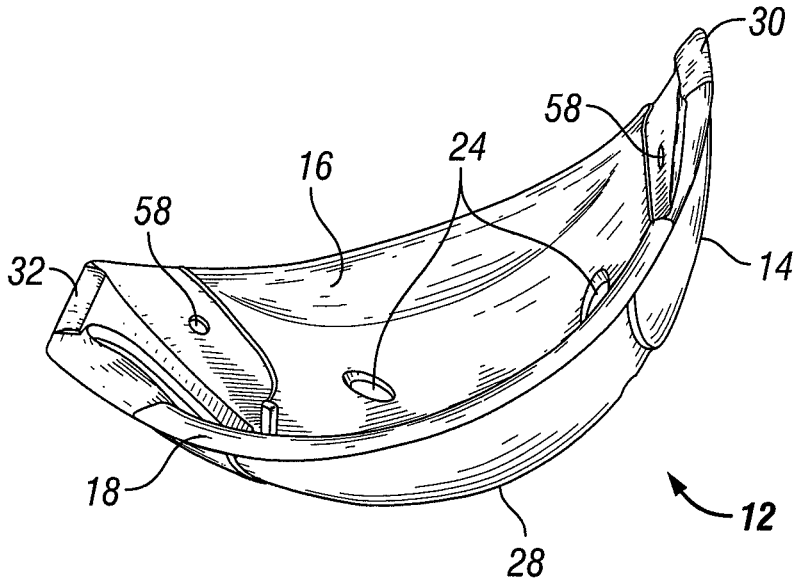
FIG. 2 is a perspective view of the inner surface of a shell of the subject invention.
Figure 7:
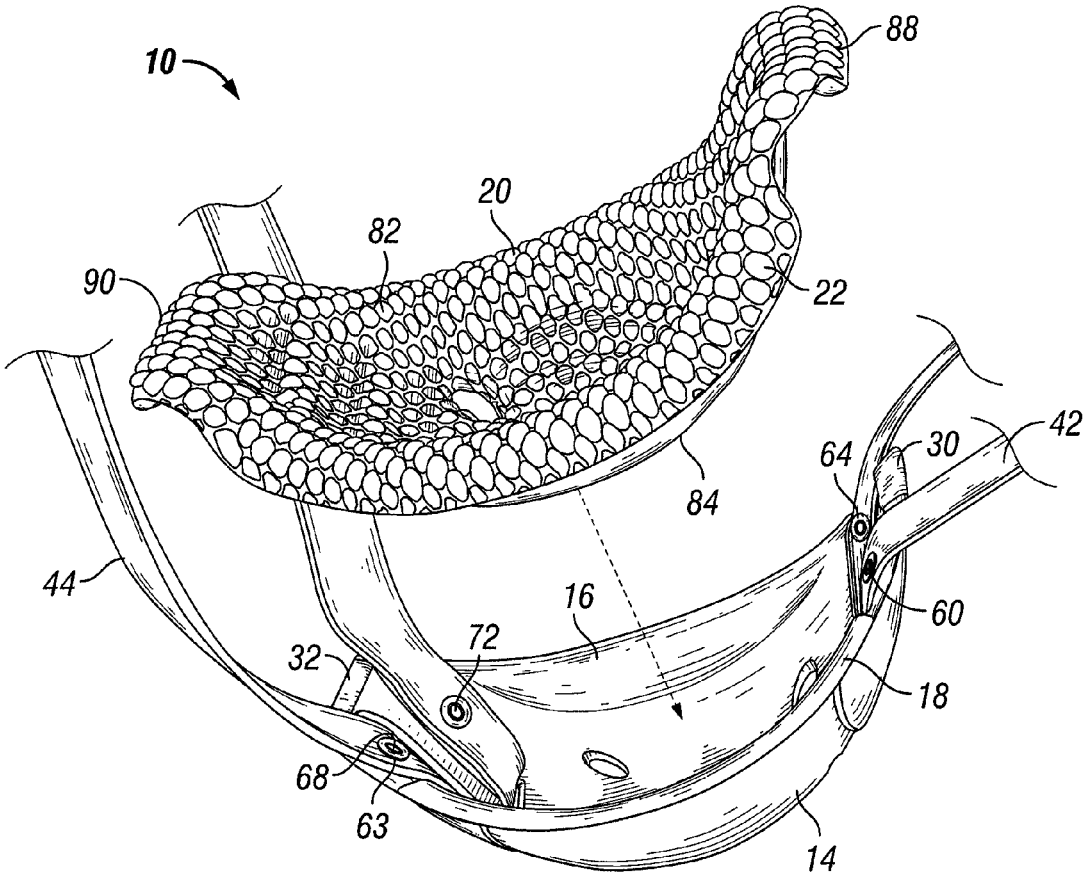
FIG. 7 is an exploded perspective view of the chin guard assembly of the subject invention.
Figure 8:
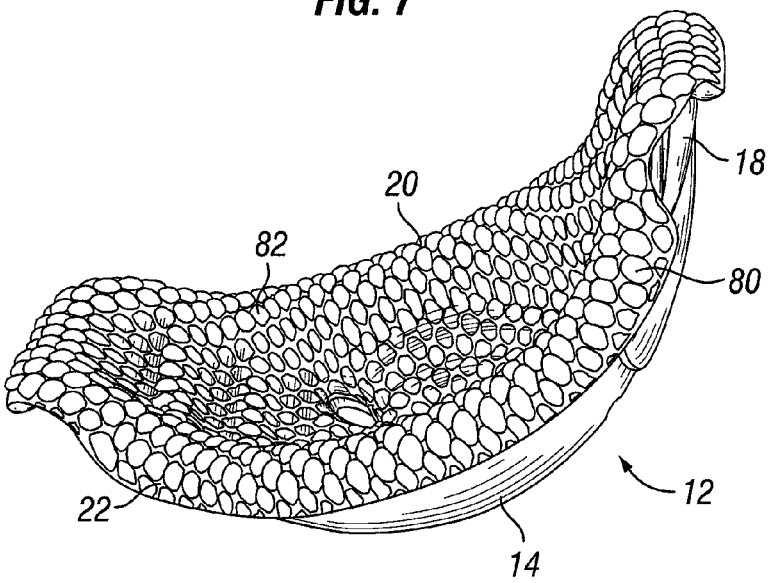
FIG. 8 is a perspective view of the chin guard assembly of the subject invention.
Figure 9:
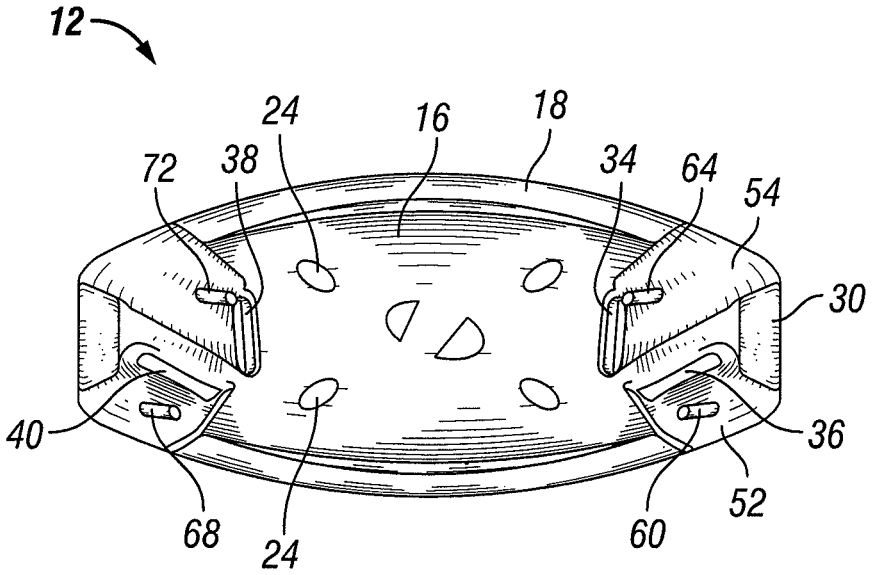
FIG. 9 is a plan view of the inner surface of the shell in FIG. 2.
Figure 10:
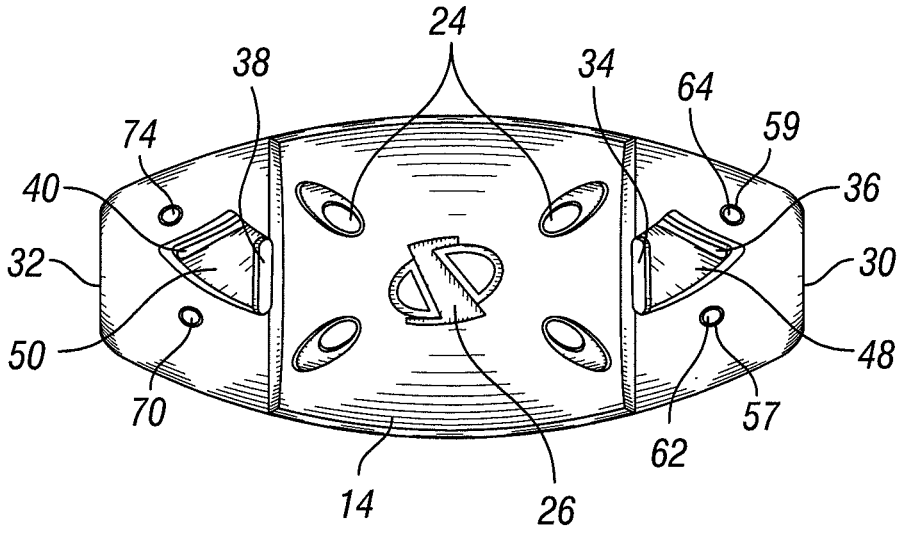
FIG. 10 is a plan view of the outer surface of the shell in FIG. 4.

The chin guard assembly 10 of the present invention is shown in FIGS. 7 and 8. The chin guard assembly 10 includes a shell 12 having an outer surface 14 and an inner surface 16 that defines a cup suitable for fitting upon a human chin. The shell 12 has an outer peripheral edge 18 extending there around (FIG. 2). A resilient layer 20 is received within the cup of the shell 12 which has a periphery 22 that overlies the outer peripheral edge 18 of the shell 12 (FIGS. 1, 8). The shell 12 also includes a plurality of openings 24 formed therethrough (FIGS. 2, 4, 9, and 10). A logo 26 or an insert can be formed centrally of the shell 12 (FIG. 10). The shell has a center portion 28 and two opposing ends that include a first end 30 and an opposite second end 32. The two opposing ends 30, 32 are thicker than the center portion 28. These areas of thickness will accommodate the formation of channels that are formed in the ends 30, 32 of the shell 12 without any loss of structural integrity of the shell 12. See FIGS. 2, 4, 7 and 10. Alternatively, the entire shell can be thicker to accommodate the formation of channels.

First end 30 of the shell 12 includes a pair of slots 34, 36 and second end 32 includes a pair of slots 38, 40. The slots 34, 36 and 38, 40 are configured to each receive a strap 42, 44 respectively. A first end of strap 42 is threaded through slots 34, 36 such that the strap 42 extends from the end 30 of shell 12. A second strap 44 is likewise threaded through the second end 32 of the shell 12. Straps 42, 44 extend outwardly from the ends 30, 32. Suitable fasteners can be included on the straps 42, 44 so as to allow the straps to be fastened to the snaps on a helmet (not shown). See FIGS. 2, 4, 5 and 10.

Figure 4:
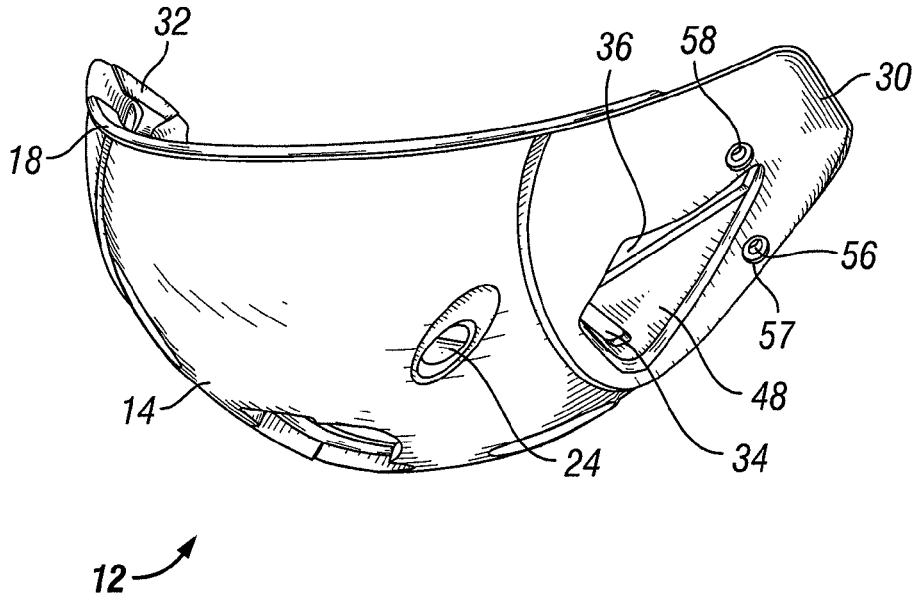
FIG. 4 is a perspective view of the outer surface of the shell of FIG. 2.
Figure 5:
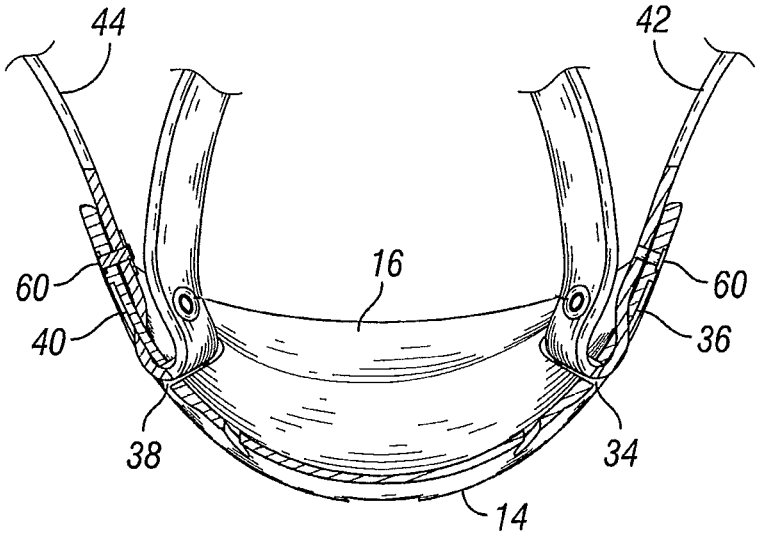
FIG. 5 is a cross sectional view of the shell including straps of the subject invention.
Figure 6:
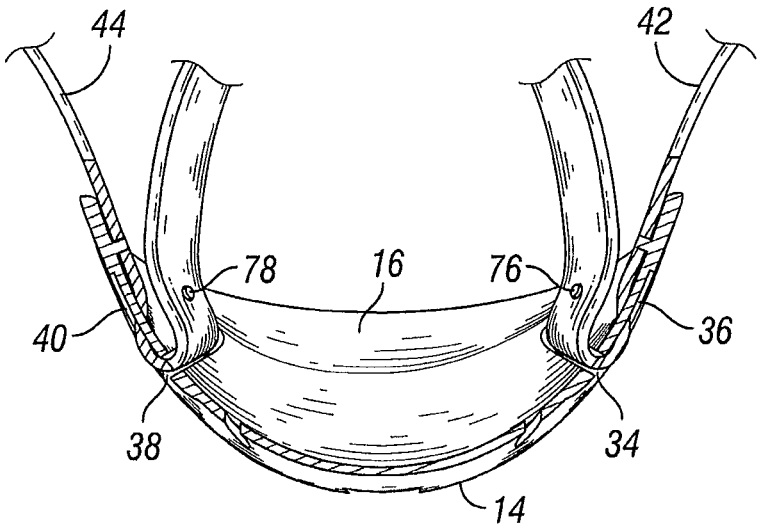
FIG. 6 is an alternate cross sectional view of the shell including straps of the subject invention.

The slots 34 and 36 open into an indented area 48 formed into the outer surface 14 of the shell 12 and slots 38, 40 open into an indented area 50 formed into the outer surface 14 of the shell 12. The indented portion 48, 50 is generally in the shape of a trapezoid. The indented areas 48, 50 have a depth approximately equal to the thickness of the straps 42, 44 and a width approximately equal to or greater than the width of the straps. As such, the indented portions 48, 50 will further serve as a guide for the proper location of the straps 42, 44 extending through the slots 34, 36 and 38, 40 respectively. See FIGS. 4 and 10. As a result, there is portion of each strap 42, 44 that resides in the indented areas 48, 50 so as to have an outer surface of each strap generally flush with the outer surface 14 of the shell 12. This presents a very smooth appearance. Since no portion of the straps 42, 44 extend outwardly beyond the outer surface 14, the straps 42, 44 will be suitably recessed so as to avoid any damaging contact with the wearer or the opponent (FIGS. 5 and 6). FIG. 5 is a cross sectional view of shell 12 showing the straps 42, 44 lying flush with the outer surface 14 of the shell 12.

Slots 34 and 36 extend in generally transverse relationship to each other. Slot 34 is spaced closer to the center portion 28 that the from the peripheral edge 18 of the shell 12 and is generally perpendicular to the long axis of the shell 12. The second slot 36 is positioned generally at a 60 degree angle to slot 34 and is somewhat parallel to a side peripheral edge of the shell 12 (FIGS. 4 and 10). The second end 32 of the shell 12 has an identical configuration of slots 38, 40 as described above.

On the inner surface 16 of the shell 12, a first channel 52 extends from slot 34 to the outer peripheral edge 18 of the shell 12. Channel 52 will have a depth generally equal to the thickness of the strap 42 passing therethrough. Channel 52 will have a width slightly equal to or slightly greater than the width of the strap 42. As such, channel 52 serves as a guide for the strap 42 passing therealong. A second channel 54 extends from slot 36 to the outer peripheral edge 18 of the shell 12. The second channel 54 will have a depth generally equal to the thickness of the strap 42 passing therethrough. Channel 54 will have a width slightly equal to or slightly greater than the width of the strap 42. As such, second channel 54 serves as a guide for the strap 42 passing therealong. See FIGS. 7 and 9. Identical channels are formed in association with slots 38 and 40 on inner surface 16 of the second end 32. In an alternate embodiment, the inner surface 16 of the shell 12 can be roughened or textured in order to provide a better bond between the shell 12 and the resilient layer 20 when the resilient layer is glued or otherwise secured to the inner surface of the shell.

A first hole 56 is formed through the shell 12 in the area of the channel 52. Hole 56 is suitable for allowing a rivet, or other fastener, to be inserted therethrough. A second hole 58 is formed through the shell 12 in the area of the second channel 54. The holes 56, 58 are formed through the thickness of the shell 12 so as to open in the area of the first and second channels 52, 54 respectively. See FIG. 4. Preferably, the holes 56, 58 will be countersunk 57, 59 as shown in FIG. 4. Holes 56, 58 allow for the insertion of a suitable fastener, or rivet, therethrough. With respect to the holes 56, 58, such holes can be pre-formed or they can be immediately formed when the rivet is forcably introduced through the thickness of the shell 12 at the specified location.

Strap 42 is received in the first channel 52 and extends through the slot 34 and down through slot 40 and is received in the second channel 54. Once the strap 42 is in place, a fastener 60 is inserted through the hole 56 so as to have a head 62 emerging through the strap 42 and bearing against the surface of the strap 42. A washer can be interposed between the head 62 of the fastener 60 and the surface of the strap 42. As such, the fastener 60 effectively secures the strap 42 in its location within the channel 52. A second fastener 64 will extend through the hole 58 so as to have a head 66 positioned against the surface of the strap 42. Another washer can be interposed between the head 66 of the fastener 64 and the surface of the strap 42. See FIGS. 5, 7 and 10.

As a result, it can be seen that the fasteners 60, 64 serve to effectively secure the strap 42 in a fixed and non-adjustable position and effectively prevent any slippage of the strap 42 during use. Generally, any irregularities in the inner surfaces of the fasteners 60, 64 will be accommodated by the placement of the resilient layer 20 thereover. Since the portion of the shell 12 through which the channels 54, 56 are formed is generally thicker than the remainder of the shell 12, the structural integrity of the shell 12 remains intact. The heads 62, 66 of the fasteners 60, 64 will generally be flush with the outer surface 14 of the shell 12. The fasteners have their respective heads 62, 66 positioned in countersunk holes in the outer surface 14. The fasteners 60, 64 can be in the nature of rivets. The opposite end of such rivets will be secured to the strap 42 adjacent to the inner surface 16 of the shell 12. A similar arrangement of fasteners 68, 72 with heads 70, 74 are provided in association with the strap 44 at end 32 of the shell 12. See FIG. 10.

Although four fasteners 60, 64 and 68, 72 are shown, a greater number of fasteners can also be used. In an alternate embodiment a single fastener 60 and 68 can be used in association with the straps 42, 44 respectively as shown in the cross sectional view of FIG. 6. In this embodiment, the single fasteners 60, 68 allows for the straps 42, 44 to be adjustable in order to fit various attachment positions located on the a helmet in order to accommodate a variety of helmet and hook up positions.

Within the concept of the present invention, the term "fastener" can include a variety of items other than the illustrated rivets. For example, sonic welding, in the nature of spot welding, can be used as the fasteners. As such, one fastener can be such that a surface of the strap is sonically welded to the outer surface 14 of the shell 12 and a second fastener can be such that another surface of the strap is sonically welded to the inner surface of the shell 12. Alternatively, fasteners 76 and 78 can be in the nature of pin members that have one end sonically welded to or molded as part of the inner surface 16 of the shell 12 in which the pin fasteners are sonically welded in holes in the straps 42, 22 (FIG. 9). In such sonic welding, the pin would extend through preformed holes in the strap and through a preformed hole in the shell. In another embodiment, pin members can have one end sonically welded to the strap surface on the outer surface 14 of the shell 12 and another end sonically welded to the strap surface at the inner surface of the shell. Such sonic welding can avoid the respective heads of the fasteners being on the outer surface 14 of the shell 12. The fasteners can be formed from metal, plastic or other material and can be secured by force, screwing, adhesive, sonic weld, radio frequency or other known methods.

Figure 3:
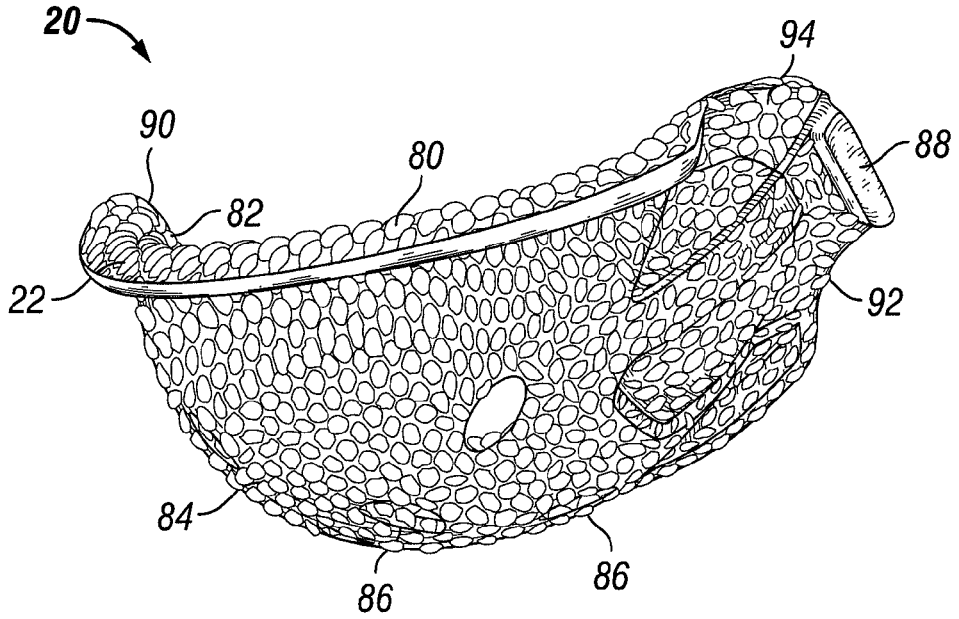
FIG. 3 is a perspective view of the outer surface of the resilient layer of FIG. 1.

The resilient layer's 20 outer periphery 22 extends over and beyond the outer peripheral edge 18 of the shell 12 on opposite sides of the shell 12 and along the ends 30, 32 (FIG. 8). This lengthy overlying relationship assures a protective cushioning effect against any sharp edges of the rigid shell 12. The resilient layer 20 has an inner surface 82 and an outer surface 84 in which inner surface 82 is configured to receive a human chin therein (FIG. 1). The outer surface 84 is configured to lay flat against the inner surface 16 of the shell 12. See FIG. 8. The inner surface 82 and periphery 22 are textured 80 such that it enhances air flow and moisture management within the inner surface 82 of the chin guard assembly 10 and around the shell's peripheral edges 18. The texturing 80 can also extend to the outer surface 84 of the resilient layer 20 (FIG. 3). Openings 86 are formed in the resilient layer 20 that correspond to the through holes 24 associated with the shell 12 (FIG. 3). As such, these openings 86 enhance the ability for air circulation to occur in relation to the resilient layer 20.

The resilient layer 20 includes a first and second end 88, 90 corresponding to the first and second ends 30, 32 of the shell 12. The outer surface 84 of the resilient layer 20 has a first indented area 92 and a second indented area 94 that correspond to the first and second channels 52, 54 of the shell 12. See FIG. 3. The positioning of the indented areas 92, 94 serves as a guide for the portions of the straps 42, 44 when the straps 42, 44 are threaded through the slots 34, 36 and 38, 40 respectively. The indented areas 92, 94 allow for the straps 42, 44 to be generally flush with the periphery of the resilient layer 20 when the resilient layer 20 is positioned within the shell 12 (FIGS. 7 and 10).

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A chin guard assembly comprising:

a shell having an outer surface and an inner surface and a first end and a second end, said shell having an outer peripheral surface extending therearound, said shell having a pair of slots formed therethrough adjacent said first end and a pair of slots formed therethrough adjacent said second end;

a first strap extending through the pair of slots adjacent said first end such that said first strap has ends extending outwardly beyond said outer peripheral surface of said shell;

a second strap extending through the pair of slots adjacent said second end such that said second strap has ends extending outwardly beyond said outer peripheral surface of said shell;

a first fastener affixed to the first strap and to said shell;

a second fastener affixed to the second strap and to said shell; and a resilient layer having an inner and outer surface and a periphery and a first end and a second end, said shell having a first indented area and a second indented area at said outer surface, said first pair of slots opening to said first indented area, said second pair of slots opening to said second indented area, the first strap having a portion positioned in said first indented area, the second strap having a portion positioned in said indented area such that an outer surface of said portion of said second strap is flush with or inwardly of said outer surface of said shell, said inner surface of said shell having a first pair of channels extending respectively from said first pair of slots, said shell having a second pair of channels extending respectively from said second pair of slots, said first and second pairs of channels opening at said outer peripheral edge of said shell.

2. The chin guard assembly of claim 1, said shell having a center portion between the first and second ends, said first and second ends each having a thickness greater than a thickness of said center portion.

3. The chin guard assembly of claim 1, the first strap having portions positioned in said first pair of channels, the second strap having portions positioned in said second pair of channels.

4. The chin guard assembly of claim 1, each of said first and second pairs of channels having a hole formed therein, said fastener positioned in the hole.

5. The chin guard assembly of claim 4, the hole having a counter sunk portion on said outer surface of said shell.

6. The chin guard assembly of claim 3, said first fastener comprising a pair of fasteners affixed to the first strap, said second fastener affixed to the second strap.

7. The chin guard assembly of claim 1, each of said first and second fasteners selected from the group consisting of a rivet, a spot welding, a pin, a pin formed as a part of said shell, and an adhesive.

8. The chin guard assembly of claim 1, each of said first and second ends of said resilient layer having a pair of indented areas, said pair of indented areas at said first end of said resilient layer corresponding in location respectively to said first pair of channels, said pair of indented areas at said second end of said resilient layer corresponding in location respectively to said second pair of channels.

9. The chin guard assembly of claim 1, said first pair of slots extending in transverse relation, said second pair of slots extending in transverse relation.

* * * * *